US010946256B2

(12) United States Patent
Lee

(10) Patent No.: US 10,946,256 B2
(45) Date of Patent: Mar. 16, 2021

(54) GOLF PUTTER HEAD AND GOLF PUTTER INCLUDING SAME

(71) Applicant: Hyun Seoung Ha, Seoul (KR)

(72) Inventor: Yeun Kyung Lee, Seoul (KR)

(73) Assignee: Hyun Seoung Ha, Seoul (KR)

( * ) Notice: Subject to any disclaimer, the term of this patent is extended or adjusted under 35 U.S.C. 154(b) by 0 days.

(21) Appl. No.: 16/332,638

(22) PCT Filed: Aug. 24, 2017

(86) PCT No.: PCT/KR2017/009284
§ 371 (c)(1),
(2) Date: Mar. 12, 2019

(87) PCT Pub. No.: WO2018/052203
PCT Pub. Date: Mar. 22, 2018

(65) Prior Publication Data

US 2020/0054923 A1 Feb. 20, 2020

(30) Foreign Application Priority Data

Sep. 13, 2016 (KR) ..... 10-2016-0118190

(51) Int. Cl.
*A63B 53/04* (2015.01)
*A63B 53/06* (2015.01)
*A63B 53/00* (2015.01)

(52) U.S. Cl.
CPC ..... *A63B 53/065* (2013.01); *A63B 53/007* (2013.01); *A63B 53/0416* (2020.08); *A63B 2053/0495* (2013.01)

(58) Field of Classification Search
CPC ..... A63B 53/0487; A63B 2053/0495; A63B 53/0495
USPC ..... 473/324–350
See application file for complete search history.

(56) References Cited

U.S. PATENT DOCUMENTS 1,665,523 A * 4/1928 Boyce ..... A63B 53/04 473/245
2,026,749 A * 1/1936 Pester ..... A63B 53/06 473/245
2,138,294 A * 11/1938 Douglas ..... A63B 53/06 473/246
2,175,598 A * 10/1939 Fedak ..... A63B 53/06 473/245
2,201,638 A * 5/1940 Theibault, Sr. ..... A63B 53/04 473/245
2,325,525 A * 7/1943 Lukenbill ..... A63B 53/007 473/201

(Continued)

FOREIGN PATENT DOCUMENTS

JP 04327865 A * 11/1992 ..... A63B 53/06
JP 05-082453 U 11/1993

(Continued)

*Primary Examiner* — Alvin A Hunter
(74) *Attorney, Agent, or Firm* — Novick, Kim & Lee, PLLC; Jae Youn Kim

(57) ABSTRACT

Provided is a golf putter head, which includes a head body; and a hitting member provided in front of the head body for hitting a golf ball, and to be freely slidable up and down within a predetermined range with respect to the head body. According to the present invention, when the golf putter hits the golf ball, as spin of the golf ball is smoother, directionality of the golf ball is increased.

19 Claims, 12 Drawing Sheets

(a)

(b)

(56) References Cited

U.S. PATENT DOCUMENTS 3,259,387 A * 7/1966 Beigay ..... A63F 7/2472 473/174
4,194,739 A * 3/1980 Thompson ..... A63B 53/0487 473/241
4,878,666 A * 11/1989 Hosoda ..... A63B 53/06 473/247
5,083,779 A * 1/1992 Ungermann ..... A63B 53/02 473/239
6,066,053 A * 5/2000 Sehemberger ..... A63B 53/0487 473/230
6,354,956 B1 * 3/2002 Doong ..... A63B 53/0466 473/219
6,386,987 B1 * 5/2002 Lejeune, Jr. ..... A63B 53/04 473/219
6,964,616 B2 * 11/2005 Dombrowski ..... A63B 53/02 473/239
7,316,622 B1 * 1/2008 Lucas ..... A63B 53/007 473/239
7,335,112 B1 * 2/2008 Bitondo ..... A63B 53/0487 473/238
7,364,513 B2 * 4/2008 Krumme ..... A63B 53/047 473/329
7,431,662 B2 * 10/2008 Tucker, Sr. ..... A63B 53/06 473/288
7,604,546 B2 * 10/2009 Brown ..... A63B 53/0487 473/230
7,651,409 B1 * 1/2010 Mier ..... A63B 60/00 473/330
7,691,006 B1 * 4/2010 Burke ..... A63B 53/06 473/288
8,353,780 B2 * 1/2013 Hatton ..... A63B 53/065 473/244
8,376,873 B2 * 2/2013 Golden ..... A63B 60/00 473/244
10,427,015 B2 * 10/2019 Balest ..... A63B 60/50
2010/0048320 A1 * 2/2010 Burrell ..... A63B 53/007 473/333

FOREIGN PATENT DOCUMENTS

JP 10118229 A * 5/1998
JP 2004016783 A * 1/2004
JP 2004237039 A * 8/2004
JP 2011015800 A * 1/2011
JP 2011-041639 A 3/2011
JP 2014158644 A * 9/2014
KR 20-0299197 Y1 1/2003
KR 10-2005-0041578 A 5/2005
KR 20-0423011 Y1 8/2006
KR 20-2009-0001469 U 2/2009
KR 10-2015-0011781 A 2/2015

* cited by examiner (a)

(b)

(a)

(b)

GOLF PUTTER HEAD AND GOLF PUTTER INCLUDING SAME

TECHNICAL FIELD

The present invention relates to a golf putter head and a golf putter having the golf putter head and, more particularly, to a golf putter head which is capable of spinning a golf ball smoothly when hitting the golf ball and to a golf putter having the golf putter head.

BACKGROUND ART

Generally, a golf club includes a head hitting a golf ball, a shaft having a pipe shape and extended from the head, and a grip provided on the shaft to allow a user to grip. Such golf club is divided into a wood, an iron, a putter, etc., and various types of golf clubs are provided depending on driving distance or angle for hitting.

Specifically, among golf clubs, the wood is used to hit the golf ball as far as possible, the iron is used to hit the golf ball to a desired position, and the putter is used to hit the golf ball on the green into a hole.

Especially, as the putter is used to knock the golf ball into the hole, accuracy is very important for moving the golf ball in a desired direction and distance. When the user hits the golf ball with the putter, the golf ball only slides on the ground and is not spun smoothly, thus it is difficult to accurately move the golf ball in the desired direction and distance.

However, when the user hits the golf ball with a conventional putter, smooth spin of the golf ball is hindered by friction between a hitting surface of the putter and the golf ball, so that the golf ball slides on the ground before it spins.

DOCUMENTS OF RELATED ART (Patent Document 1) Korean Utility Model Registration No. 20-0299197.

DISCLOSURE

Technical Problem

Accordingly, the present invention has been made keeping in mind the above problems occurring in the prior art, and an object of the present invention is to provide a golf putter head and a golf putter having the golf putter head, in which the golf putter head can smoothly spin a golf ball when a user hits the golf ball with the putter.

Technical Solution

In order to accomplish the above object, the present invention provides a golf putter head. According to an embodiment of the present invention, the golf putter head includes: a head body; and a hitting member provided at front of the head body for hitting a ball, and to be freely slidable up and down within a predetermined range with respect to the head body.

The hitting member may be shaped into a plate and at least one sliding part sliding with respect to the head body may be provided on a side opposite to a golf ball hitting surface of the hitting member.

At the front of the head body, a guide member having a predetermined height may be provided on a position corresponding to the at least one sliding part to guide sliding of the sliding part of the hitting member within a predetermined range.

At least one ball bearing for smooth sliding may be disposed between the guide member and the sliding part.

The head body may include a front body in which the hitting member is mounted and a rear body provided to slide freely in a back and forth direction with respect to the front body.

The golf putter head may further include: at least one buffer provided between the front body and the rear body.

The buffer may be one of a sponge, a spring, a cylinder, and a shock absorber.

The golf putter head may further include: a lifting device for actively lifting the hitting member with respect to the head body by transmitting compressive force between the front body and the rear body to the hitting member when a putter hits the golf ball.

The rear body may include at least one horizontal rack gear at a front surface thereof, and the front body may include a pinion gear which is rotated on a shaft parallel with a longitudinal direction of the front body by back and forth movement of the horizontal rack gear, and the hitting member may be provided with a vertical rack gear at a rear surface thereof which the rack gear moves up and down by rotation of the pinion gear.

The pinion gear may include a first pinion gear and a second pinion gear which have different diameters and are disposed on the rotational shaft, and one of the first and the second pinion gear may be connected to the horizontal rack gear, and the other one may be connected to the vertical rack gear.

The golf putter head may further include: an extension part included in the hitting member and projecting upwardly above an upper surface of the head body a first hinge connector provided on an upper end of the extension part; a second hinge connector provided on an upper surface of the rear body; and a rod including a first and a second end which are respectively hinged to the first hinge connector and the second hinge connector.

The golf putter head may further include: a first cylinder horizontally provided at rear of the front body; a second cylinder vertically provided on a upper part of the front body; and a flow path communicating from inside of the first cylinder to inside of the second cylinder, wherein the first cylinder may include a first piston rod extended toward the rear body, the second cylinder may include a second piston rod extended upward, and the hitting member may include a connecting part extended in contact with an upper end of the second piston rod.

A diameter of the first cylinder may be larger than a diameter of the second cylinder.

The first and the second cylinder may be a hydraulic cylinder or a pneumatic cylinder.

Any one of the front body and the rear body may be provided with at least one hole penetrating the body in the back and forth direction, and the other one thereof may be provided with a shaft penetrating the hole.

Any one of the front body and the rear body may be provided with a linear bush to smooth linear motion in the back and forth direction of the shaft moving through the hole.

The shaft may be provided with a shock absorbing member on an outer circumference thereof to relieve shock between the front body and the rear body.

In addition, the present invention provides a golf putter, which includes: the golf putter head; and a handle connected to the head body of the golf putter head.

The handle of the golf putter may be connected to the rear body.

Advantageous Effects

As described above, in the case of a golf putter head and a golf putter having the golf putter head according to the present invention, since a hitting member having a hitting surface in contact with a golf ball is lifted when hitting the golf ball, spin of the golf ball may be induced smoothly. Accordingly, a user can move the golf ball more accurately to a desired direction.

In addition, according to the present invention, a buffer is provided between a front body and a rear body of the golf putter head to absorb impact when the golf ball is hit, so that the golf ball may be prevented from sliding with respect to the ground by momentary impact, and the spin of the golf ball may be smoother.

MODE FOR INVENTION

Hereinafter, embodiments of the present invention will be described with reference to the accompanying drawings. The embodiments is intended to describe the present invention in detail, it should be understood by those skilled in the art that the scope and spirit of the present invention are not limited to the embodiments described hereinbelow.

Figure 1:
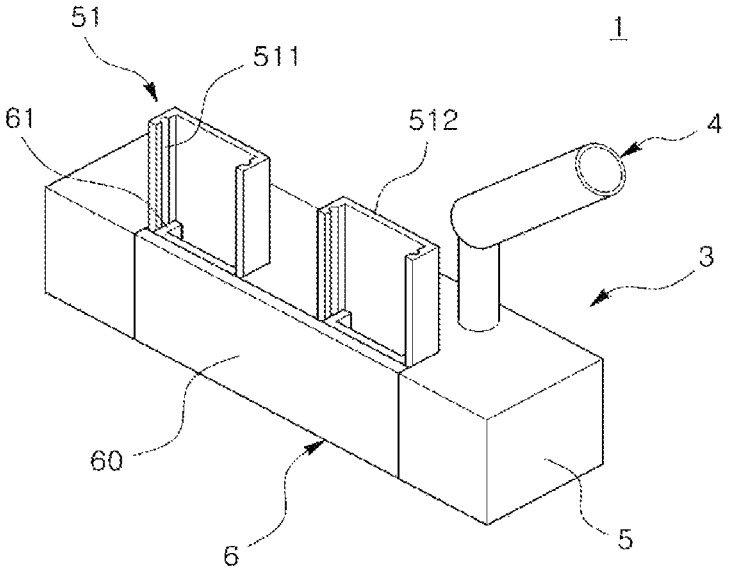
FIG. 1 is a perspective view showing a golf putter including a golf putter head according to a first embodiment of the present invention.
Figure 1:
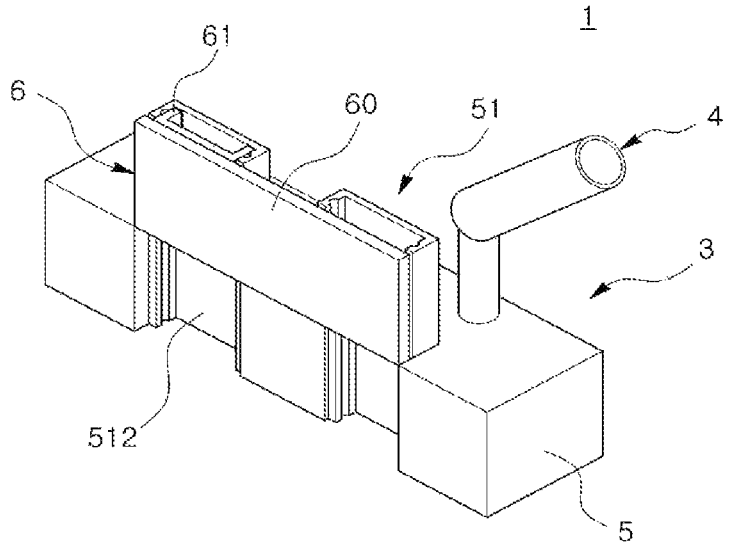
Figure 2:
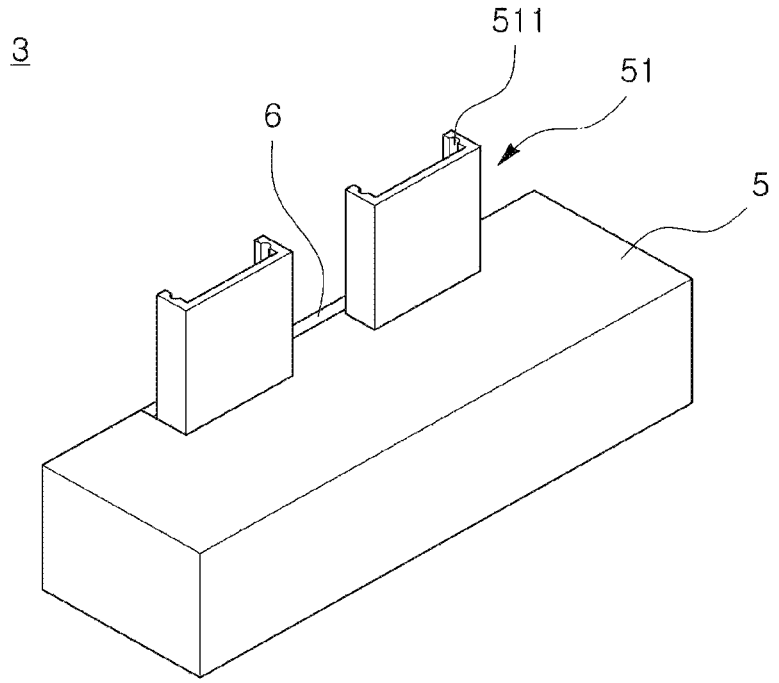
FIG. 2 is a perspective view showing the golf putter head according to the first embodiment of the present invention.
Figure 3:
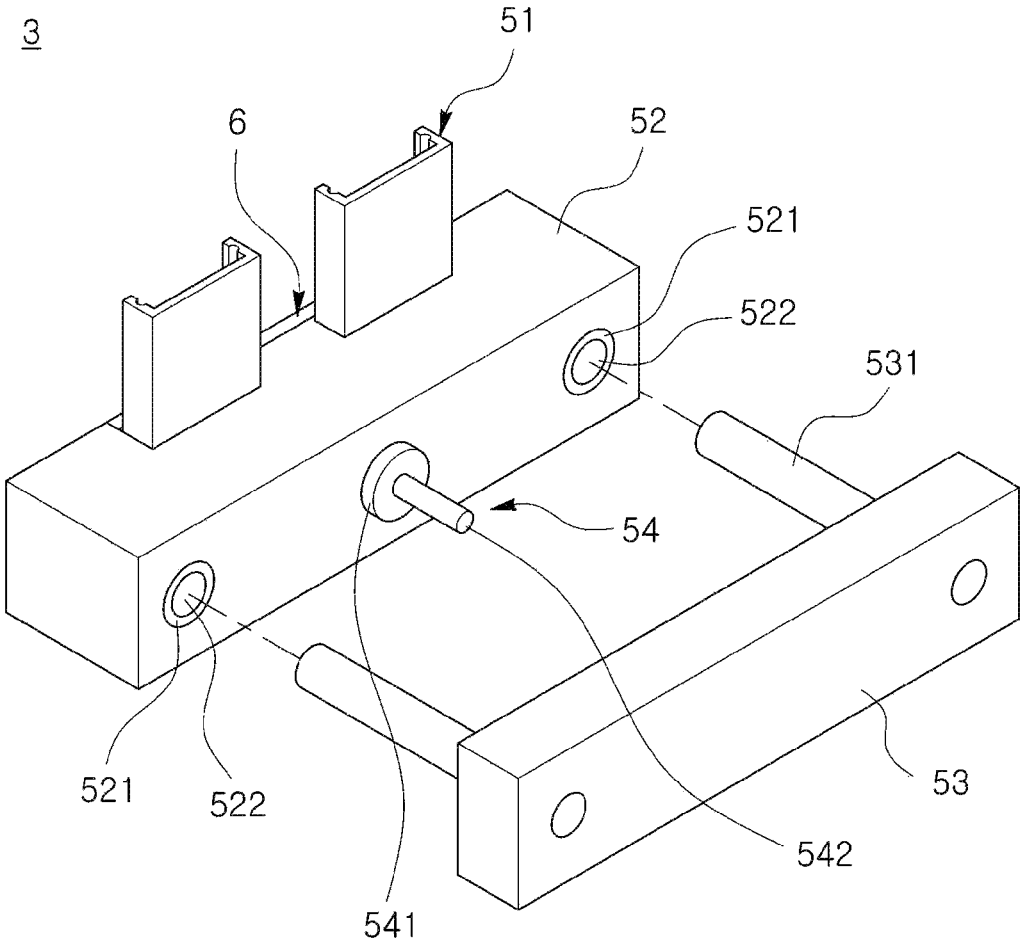
FIG. 3 is a perspective view showing a golf putter head according to a second embodiment of the present invention.
Figure 4:
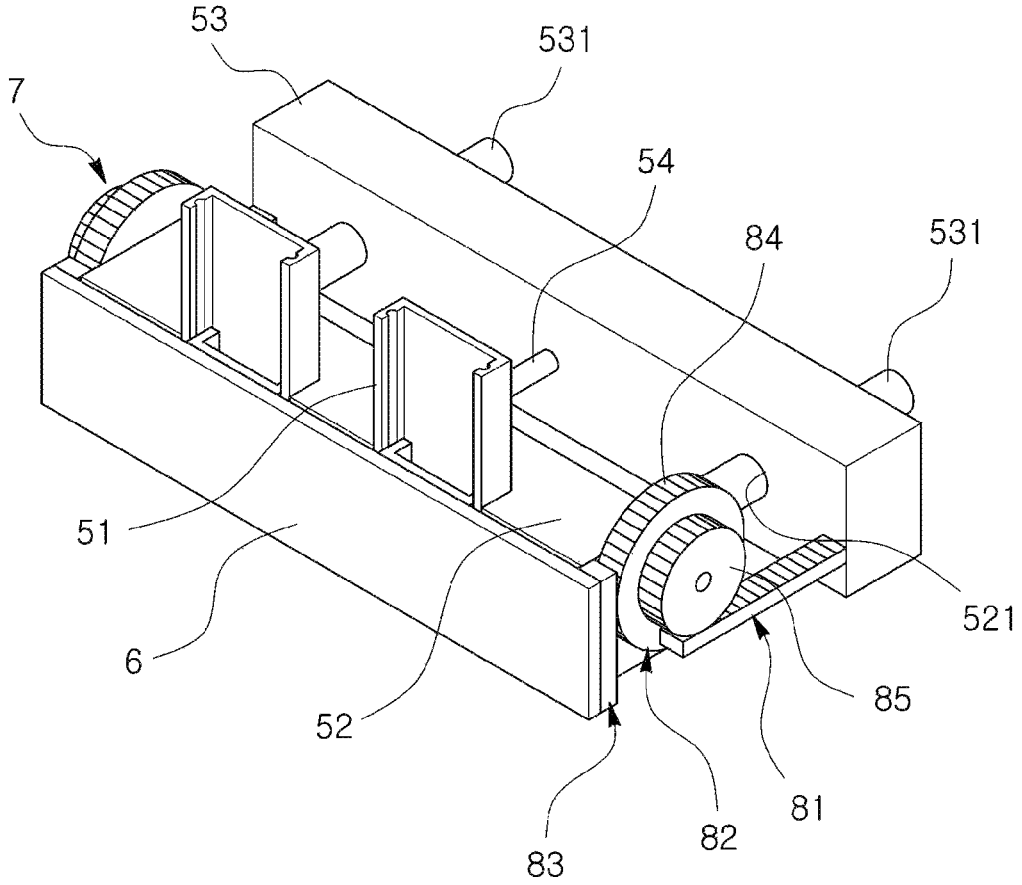
FIG. 4 is a perspective view showing a golf putter head according to a third embodiment of the present invention before the golf putter head hits a golf ball.
Figure 5:
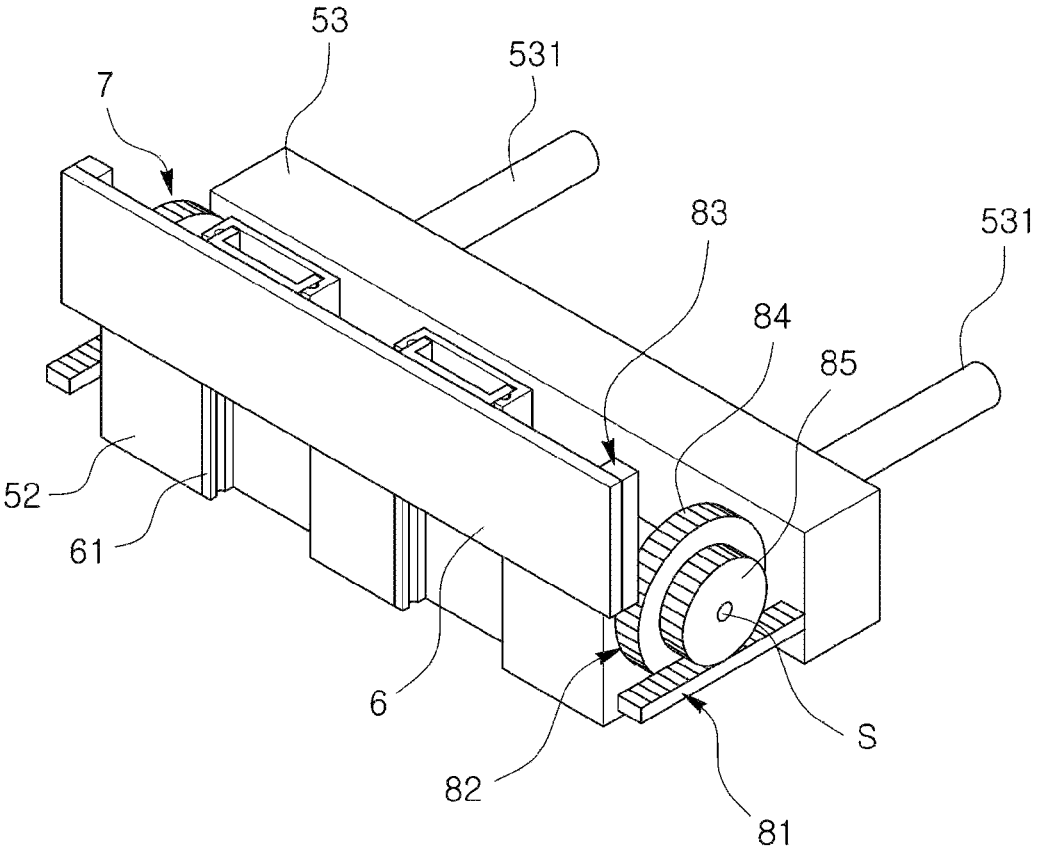
FIG. 5 is a perspective view showing the golf putter head according to the third embodiment of the present invention after the golf putter head hits the golf ball.
Figure 6:
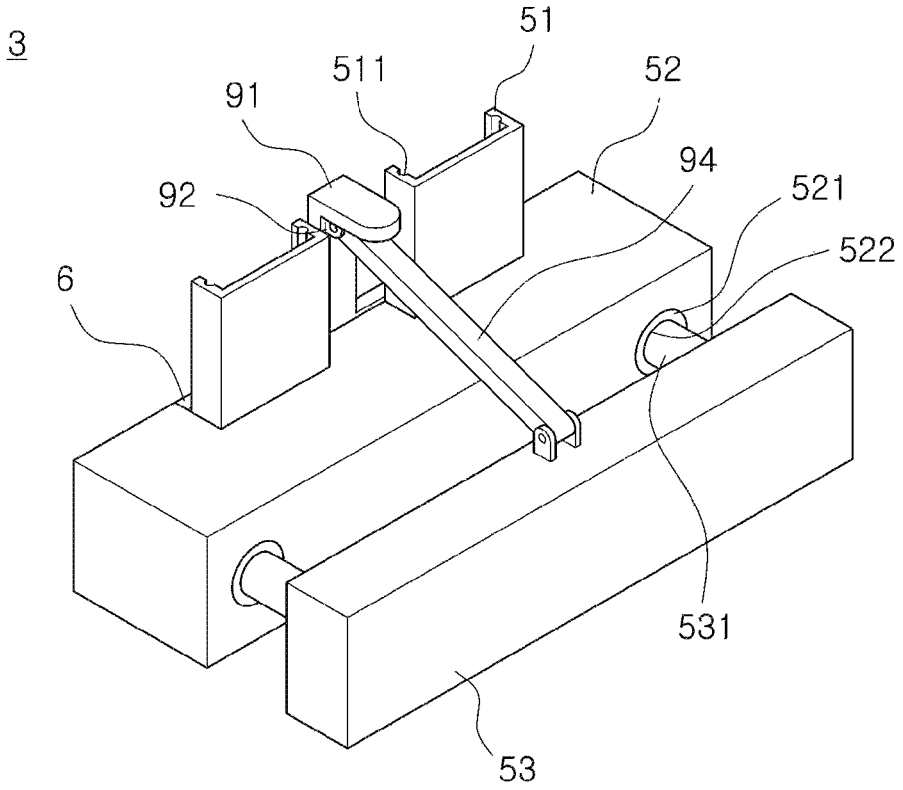
FIG. 6 is a perspective view showing a golf putter head according to a fourth embodiment of the present invention.
Figure 7:
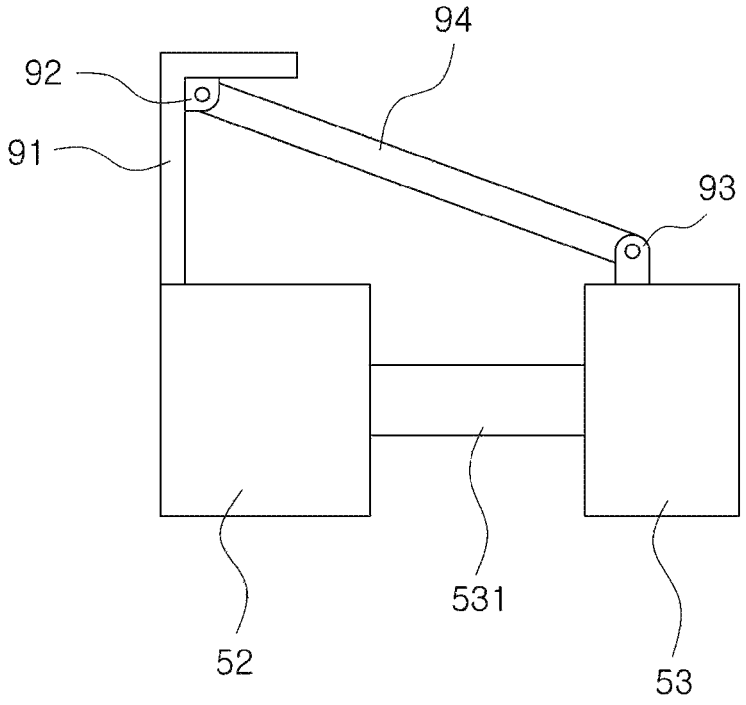
FIG. 7 is a perspective view schematically showing a principal part of the golf putter head according to the fourth embodiment of the present invention.
Figure 8:
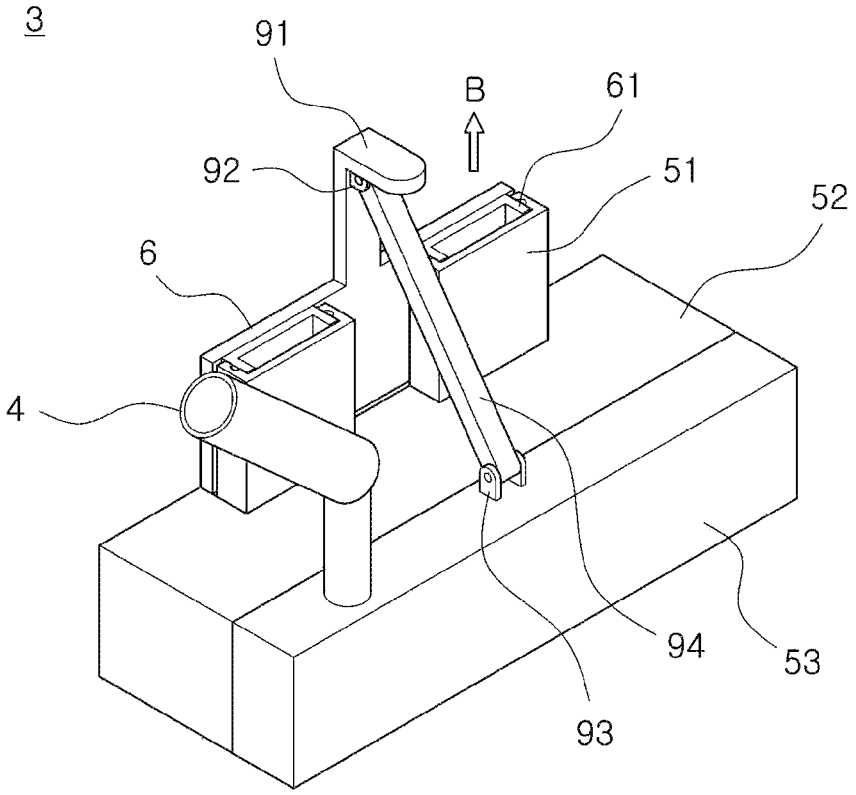
FIG. 8 is a view showing the golf putter head according to the fourth embodiment of the present invention after the golf putter head hits the golf ball.
Figure 9:
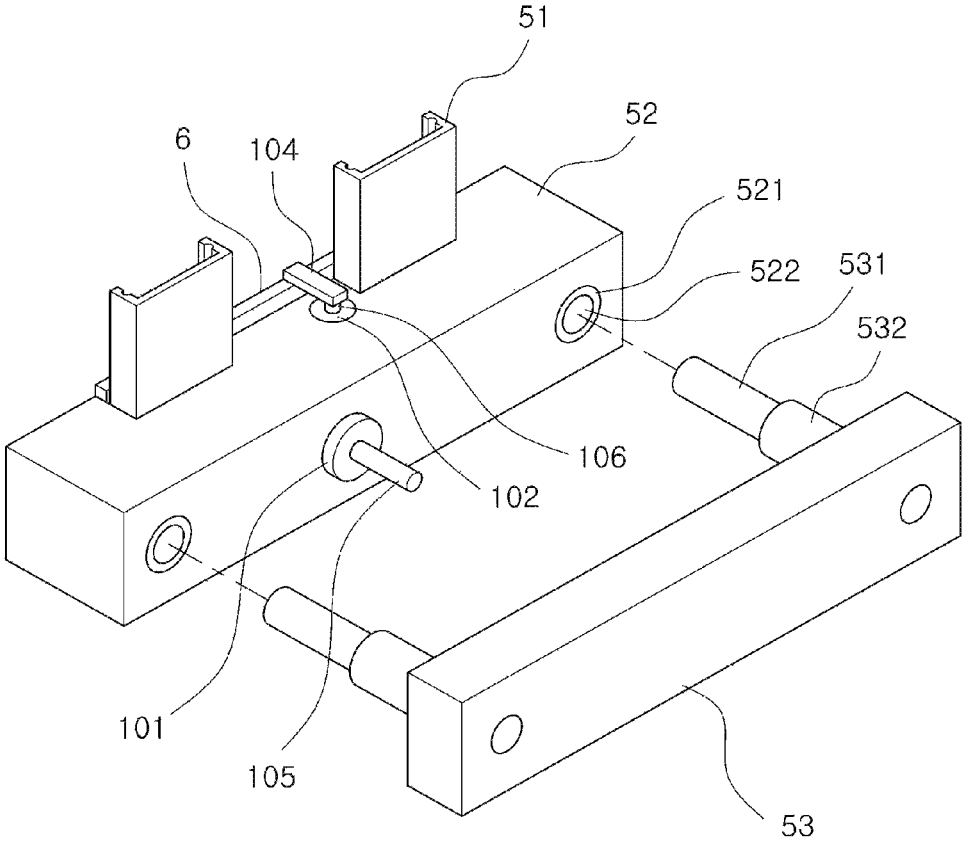
FIG. 9 is a perspective view showing a golf putter head according to a fifth embodiment of the present invention.
Figure 10:
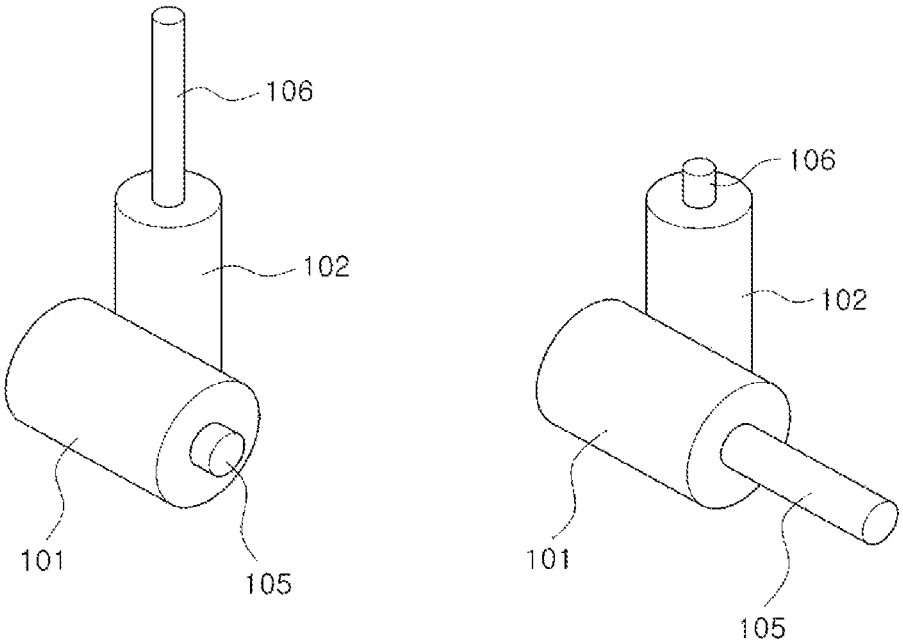
FIG. 10 is a perspective view showing a first and a second cylinder of the golf putter head according to the fifth embodiment of the present invention.
Figure 11:
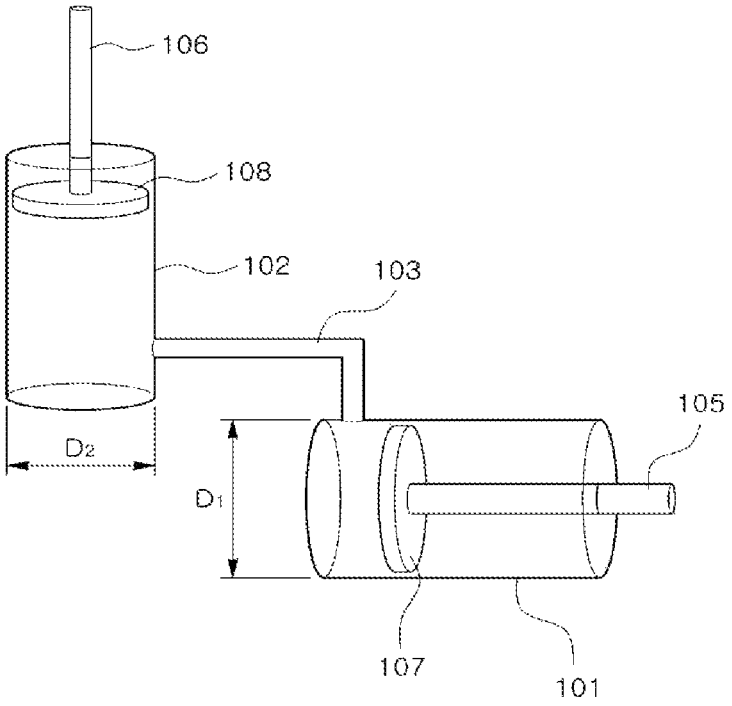
FIG. 11 is a view showing an example of a flow path which connects the first and the second cylinder of the golf putter head according to the fifth embodiment of the present invention.
Figure 12:
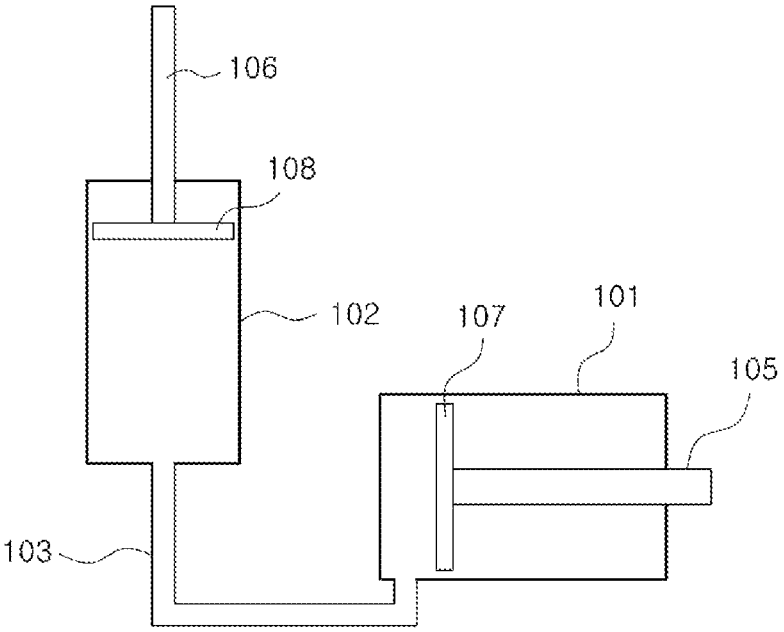
FIG. 12 is a view showing another example of the flow path which connects the first and the second cylinder of the golf putter head according to the fifth embodiment of the present invention.
Figure 13:
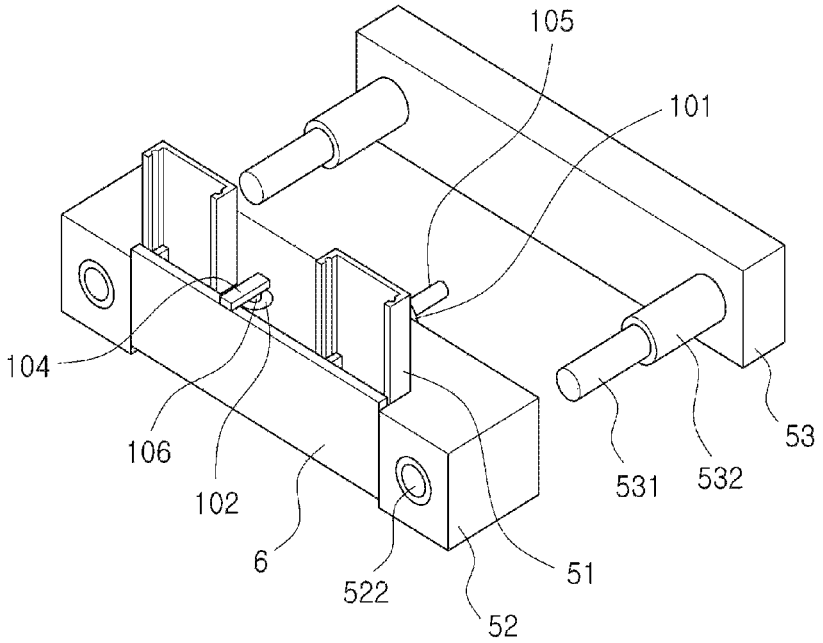
FIG. 13 is a perspective view showing operation of the golf putter head according to the fifth embodiment of the present invention.
Figure 13:
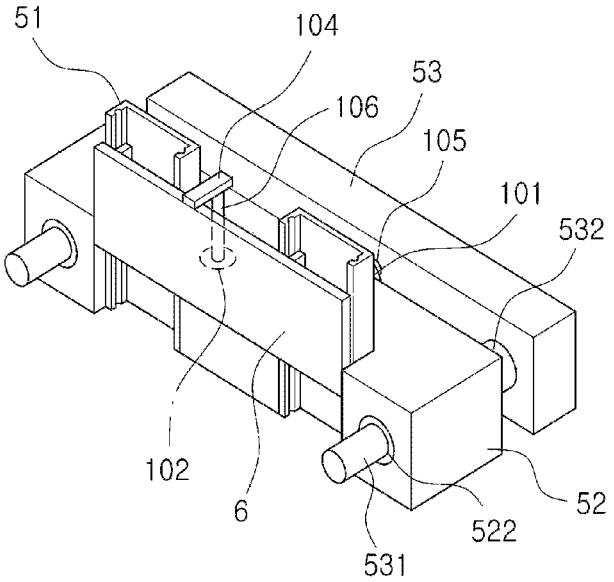
Figure 14:
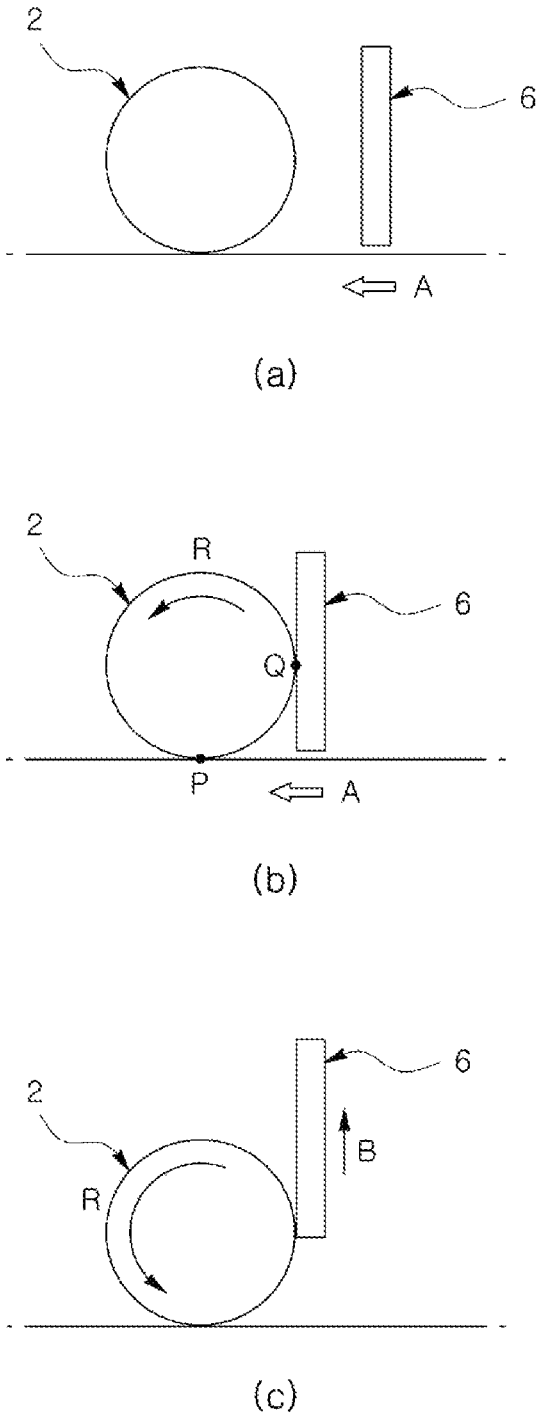
FIG. 14 is a view showing steps of hitting the golf ball by a hitting member of the golf putter head according to the embodiment of the present invention.
Figure 15:
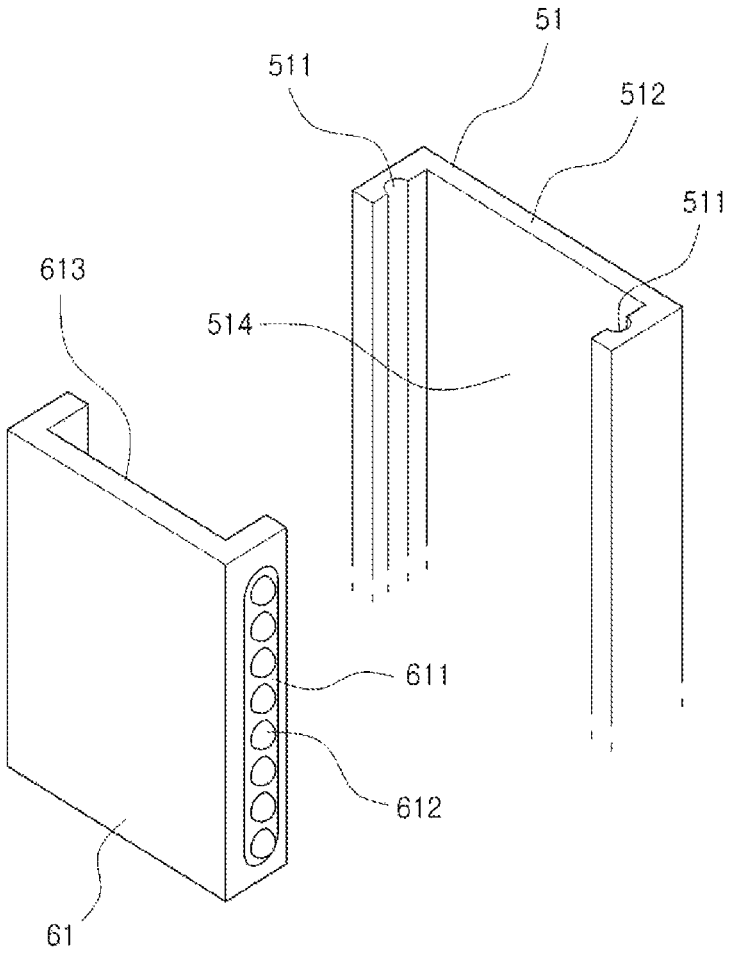
FIG. 15 is a view showing a guide member and a sliding part according to the embodiment of the present invention.

FIG. 1 is a perspective view showing a golf putter including a golf putter head according to a first embodiment of the present invention. FIG. 2 is a perspective view showing the golf putter head according to the first embodiment of the present invention. FIG. 3 is a perspective view showing a golf putter head according to a second embodiment of the present invention. FIGS. 4 to 5 are perspective views showing a golf putter head according to a third embodiment of the present invention. FIGS. 6 to 8 are perspective views showing a golf putter head according to a fourth embodiment of the present invention. FIG. 9 is a perspective view showing a golf putter head according to a fifth embodiment of the present invention. FIGS. 10 to 12 are views showing connection relationship between a first and a second cylinder of the golf putter head according to the fifth embodiment of the present invention. FIG. 13 is a perspective view showing operation of the golf putter head according to the fifth embodiment of the present invention. FIG. 14 is a view showing moving relationship between the golf ball and a hitting member of the golf putter head according to the embodiment of the present invention. FIG. 15 is a view showing a guide member and a sliding part according to the embodiment of the present invention.

As shown in FIGS. 1 to 2, a golf putter 1 according to a first embodiment of the present invention is configured of a golf putter head 3 and a handle 4, and the golf putter head 3 includes a head body 5, a hitting member 6 having a golf ball hitting surface installed on the head body 5, and a guide member 51 provided between the hitting member 6 and the head body 5 to guide the hitting member 6 to slide up and down. As the configuration of the golf putter head 3 according to the first embodiment of the present invention is primary, it is applied to a golf putter head according to a second to the fifth embodiment.

The head body 5 is a part connected to the handle 4, and may be formed of a metal material and have a predetermined weight.

The hitting member 6 is installed in the front of the head body 5, is installed to freely slide up and down with respect to the head body 5 within a predetermined range, and may be formed of the metal material which is the same as the head body.

The hitting member 6 may be formed into a rectangular plate shape. The hitting member 6 is formed less than a front surface of the head body 5 and is installed to be located on the same plane as the front surface of the head body 5 as shown in FIG. 1. If necessary, the hitting member 6 may be formed into a rectangular plate shape larger than the front surface of the head body 5 as shown in FIG. 4, and be located forward of the front surface of the head body 5.

In order to secure the hitting member 6 to slide up and down with respect to the head body 5, the head body 5 may be provided with the guide member 51 for guiding the sliding in an up and down direction of the hitting member 6. In addition, a sliding part 61 may be provided in the rear of the hitting member 6 and slide with respect to the guide member 51. In the embodiment of FIGS. 1 to 2, the guide member 51 is shown in a separate configuration from the head body 5, but this is only one embodiment, the guide member 51 may be formed integrally with the head body 5.

In one or more embodiments, as shown in FIGS. 1, 2 and 15, the guide member 51 is formed into a column shape with a predetermined height which the column has a '⊏'-shaped cross section cut with respect to a plane parallel to the horizontal plane. At opposite sides therein, a groove 511 having a semicircular cross section may be formed in a longitudinal direction. As shown in FIG. 15, the sliding part 61 of the hitting member 6 is formed into a '⊏'-shape and may be inserted inside the '⊏'-shape of the guide member 51 in a direction of facing the guide member 51. On opposite outer sides of the sliding part 61 of the hitting member 6, a groove 611 having a semicircular cross-section corresponding to the groove 511 of the facing guide member 51 is formed within a predetermined range. A plurality of ball bearings 612 may be provided inside the groove 611 of the sliding part 61. The hitting member 6 may smoothly slide up and down inside the guide member 51 by the ball bearing 612 disposed between the groove 511 of the guide member 51 and the groove 611 of the sliding part 61. However, this is only one embodiment, and any structure capable of sliding the hitting member 6 with respect to the head body can be applied thereto.

The guide member 51 may include at least one stopper (not shown) so as to limit sliding movement in the up and down direction of the hitting member 6 within the predetermined range. A shape of the stopper is not limited, and anything that can limit the sliding movement in the up and down direction of the hitting member 6 can be the stopper. In one or more embodiments, the stopper may include an upper plate (not shown) for covering an upper end of the guide member 51 as shown in FIG. 15 to limit upward movement of the sliding part 61, and like described above, the stopper may include a lower plate (not shown) for covering a lower end of the guide member 51 to limit downward movement of the sliding part 61. As another embodiment, the stopper may be formed into a shape that partially blocks the groove 511 formed in the longitudinal direction on the guide member 51 with respect to an upper and a lower part of the groove 511. In a blocked portion of the groove 511 of the guide member 51, the ball bearing 612 of the sliding part 61 may not move anymore, such the portion that blocks the groove 511 from above or below may be the stopper. As the third embodiment, a projection may protrude rearward from a rear part 613 of the sliding part 61, and a limiting member capable of being in contact with the projection may protrude forward from an upper and a lower part of a front part 514 of the guide member 51 facing the rear part 613. By the stopper, the hitting member 6 is not separated out of the guide member 51. In particular, a lower surface of the hitting member 6 may be prevented from descending below a lower surface of the head body 5 and from coming in contact with the ground.

FIG. 14 shows a case in which a golf ball 2 is hit by the hitting member 6 of the golf putter head according to the embodiment of the present invention. As shown in FIGS. 14*a* and 14*b*, the golf ball 2 is in contact with the ground at a point P while rubbing against the ground. When the hitting member 6 of the golf putter head hits the golf ball in this state, the golf ball 2 spins in a counterclockwise direction R because it rubs against the ground at the point P. However, in case of the conventional art, a front surface 6 of the golf putter head and the golf ball 2 are in contact with each other at a point Q while rubbing in this state. Therefore, spin in the counterclockwise direction R of the golf ball 2 is hindered by friction at the point Q, so that the golf ball 2 may not spin smoothly. Contrarily, in the golf putter head 3 according to the embodiment of the present invention, the hitting member 6 of the golf putter head 3 may freely slide up and down with respect to the head body 5, so that the hitting member 6 slidingly moves upward as shown in FIG. 14*c* in the state of FIG. 14*b* and does not interfere with the spin in counterclockwise direction R of the golf ball 2. After that, the hitting member 6 descends to its original position according to gravity after the golf ball 2 moves forward while spinning. Accordingly, in case of the golf putter head 3 according to the embodiment of the present invention, when the golf ball 2 is hit, the spin of the golf ball 2 is smoothly performed and straightness of the golf ball 2 is improved, so that a user can move the golf ball in a desired direction.

FIG. 3 shows a view showing the golf putter head 3 according to the second embodiment of the present invention. According to the second embodiment of the present invention, the golf putter head 3 includes a front body 52 hitting the golf ball 2, a rear body 53 connected to the handle 4, and a buffer 54 disposed between the front body 52 and the rear body 53.

The guide member 51 and the hitting member 6 are provided on a front surface of the front body 52. The guide member 51 and the hitting member 6 are the same as described in the first embodiment, thus a detailed description thereof will be omitted.

The front body 52 is installed to be freely slidable forward and rearward with respect to the rear body 53. In one or more embodiments, any one of the front body 52 and the rear body 53 is provided with a hole 521 passing through the body in a front and rear direction and the other one is provided with a shaft 531 extended in a horizontal direction, and as the shaft 531 moves through the hole 521, the front body 52 and the rear body 53 slide toward each other. In order to smooth the sliding, the hole 521 may be provided with a linear bush 522. Although the drawings are not specifically shown, a predetermined projection or a flange may be provided on an end part of the shaft 531 so that the shaft 531 does not completely deviate out of the hole 521 or the linear bush 522. In the second embodiment shown in FIG. 3, two holes 521 are provided on opposite sides of the front body 52, each of the holes 521 is provided with the linear bush 522 and at corresponding positions, and two shafts 531 are provided on opposite sides of the rear body 53. However, as shown in FIG. 4, when the hitting member 6 is formed longer than the front body 52, the hole 521 and the linear bush 522 may be provided on the rear body 53, and the shaft 531 may be provided on the rear of the front body 52.

The buffer 54 reduces impact when the golf ball 2 is hit and prevents the front body 52 and the rear body 53 from rapidly approaching each other. In one or more embodiments, the buffer 54 may be any one of a sponge, a spring, a cylinder, and a shock absorber. For example, when the shock absorber is horizontally provided at the rear of the front body 52, and the front body 52 and the rear body 53 are close to each other at the time of hitting, the impact is reduced by the shock absorber. Likewise, a cylinder 541 may be inserted in the rear of the front body 52 and a piston rod 542 provided in the cylinder 541 may be extended horizontally toward the rear body.

In the golf putter head 3 according to the second embodiment of the present invention, the spin of the golf ball 2 may be smoothly performed. Referring to the embodiment shown in FIG. 14, since the golf ball 2 is at rest on the ground before hitting as shown in FIG. 14*a*, depending on inertial of the golf ball and state of ground, even if hitting occurs, the golf ball 2 may be difficult to be spun immediately. In case of hitting the golf ball 2 by the hitting member 6 in the state of FIG. 14*b*, when large impact is applied to the golf ball 2 for a very short moment, the golf ball 2 may slidingly move with respect to the ground before the golf ball 2 spins well enough, so that spin of the golf ball 2 and progress directional performance according to the spin may deteriorate. However, according to the second embodiment of the present invention, when the golf ball 2 is hit, the buffer 54 absorbs the impact of the hitting as the front body 52 moves toward the rear body 53, so that the golf ball 2 is prevented from sliding with respect to the ground before spinning. During absorbing the impact, the hitting member 6 corresponds thereto and ascends upward enough thereby allowing the golf ball 2 to spin smoothly as shown in FIG. 14*c*.

In case of the third embodiment to the fifth embodiment of the present invention shown in FIGS. 4 to 13, all configurations of the second embodiment may be included therein. Moreover, when the golf ball 2 is hit, a lifting device 7 is further included so that the hitting member 6 may slide upward more actively. In case of the third embodiment shown in FIGS. 4 to 5, a plurality of gears is used as the lifting device 7. In case of the fourth embodiment shown in FIGS. 6 to 8, a rod is used as the lifting device 7. In case of the fifth embodiment shown in FIGS. 9 to 13, a plurality of hydraulic cylinders or pneumatic cylinders is used as the lifting device 7. Hereinbelow, each embodiment will be described.

In case of the golf putter head 3 according to the third embodiment of the present invention shown in FIGS. 4 to 5, the rear body 53 includes at least one horizontal rack gear 81 at a front surface thereof, the front body 52 includes a pinion gear 82 rotating on an rotational shaft S parallel with a longitudinal direction of the front body 52 by back and forth movement of the horizontal rack gear 81, and the hitting member 6 includes a vertical rack gear 83 for sliding up and down by the rotation of the pinion gear 82 at a rear surface thereof.

In one or more embodiments, as shown in FIGS. 4 to 5, the pinion gear 82 may be provided on the opposite sides of the front body 52, and may be configured such that a first pinion gear 84 and a second pinion gear 85 having different diameters are coupled to each other along a direction of the rotational shaft S. By appropriately setting a gear ratio using the pinion gears 82 of different sizes, a height at which the hitting member 6 is lifted may be larger than a distance at which the front body 52 and the rear body 53 are close to each other. According to the third embodiment of the present invention, the first pinion gear 84 of a larger diameter is coupled to the vertical rack gear 83 of the hitting member 6. To do this, as shown in FIGS. 4 to 5, the hitting member 6 is extended longer than the front body 52 toward opposite sides of the longitudinal direction, the vertical rack gear 83 is provided at opposite sides of the rear surface extended beyond the front body 52 and connected to the first pinion gear 84. In addition, as shown in FIGS. 4 to 5, a length of the rear body 53 is longer than a length of the front body 52, so that horizontal rack gears 81 are respectively provided on opposite end parts of the rear body and may be respectively connected to the second pinion gear 85 provided on the opposite sides of the front body 52.

FIG. 4 shows a state of the golf putter head 3 according to the third embodiment before hitting the golf ball 2, and FIG. 5 shows the golf putter head 3 according to the third embodiment after hitting the golf ball 2. When the golf putter head 3 hits the golf ball 2 in a state of FIG. 4, as the front body 52 and the rear body 53 are close to each other, the horizontal rack gear 81 of the rear body 53 rotates the second pinion gear 85 of the front body 52 in a clockwise direction, and thus, the first pinion gear 84 coupled to the second pinion gear 85 is rotated therewith. As the first pinion gear 84 is rotated in the clockwise direction, the vertical rack gear 83 of the hitting member 6 connected thereto is lifted upward. Here, since the first pinion gear 84 has a larger diameter than the second pinion gear 85, the vertical rack gear 83 moves upward by a larger distance than a distance at which the horizontal rack gear 81 moves.

Accordingly, as the third embodiment of the present invention has the same effect as the second embodiment. Furthermore, since the hitting member 6 may be actively lifted upward when hitting the golf ball 2, so that the spin of the golf ball 2 is smoother, and straightness and directionality of the golf ball 2 are further improved.

However, since FIGS. 4 to 5 show only one embodiment, it is possible to allow one pinion gear having one diameter to engage the horizontal rack gear and the vertical rack gear at the same time.

In case of the golf putter head 3 according to the fourth embodiment of the present invention shown in FIGS. 6 to 8, the hitting member 6 includes an extension part 91 projecting upwardly above an upper surface of the head body 5, a first hinge connector 92 is provided on an upper end of the extension part 91, a second hinge connector 93 is provided on an upper surface of the rear body 53, and a rod 94 is provided with the first end 95 and the second end 96 that are hinged to the first hinge connector 92 and the second hinge connector 93.

As shown in FIG. 8, the extension part 91 may be extended upward at the center of an upper surface of the hitting member 6 and have a form in which the upper end part is bent rearward in a '¬' shape. As shown in FIG. 7, the first hinge connector 92 is provided inside the '¬' shape, and the first end 95 of the rod 94 is hinged thereto. The second end 96 of the rod 94 is hinged to the second hinge connector 93 formed on a predetermined position of the rear body 53. Accordingly, the rod 94 is provided on the head body 5 in a state of having a predetermined angle and an inclined form.

FIG. 6 shows the golf putter head 3 according to the fourth embodiments of the present invention before hitting the golf ball 2, and FIG. 8 shows the golf putter head 3 according to the fourth embodiment of the present invention after hitting the golf ball 2. When the golf putter head 3 hits the golf ball 2 in a state of FIG. 6, the front body 52 and the rear body 53 are close to each other, and a grade of the rod 94 to the horizontal plane increases to lift the extension part 91 upwardly as shown in FIG. 8, so that the hitting member 6 moves upward.

Accordingly, the fourth embodiment of the present invention has the same effect of the second embodiment. Furthermore, when the golf putter head 3 hits the golf ball 2, the hitting member 6 may be actively lifted upward, so that the spin of the golf ball 2 becomes smoother, and the straightness and the directionality of the golf ball 2 are improved.

In case of the golf putter head 3 according to the fifth embodiment of the present invention shown in FIGS. 9 to 13, the golf putter head 3 includes a first cylinder 101 horizontally installed at rear of the front body 52, a second cylinder 102 vertically installed on a upper part of the front body 52, and a flow path 103 communicating from the inside of the first cylinder 101 to the inside of the second cylinder 102. The first cylinder 101 includes a first piston rod 105 extended toward the rear body 53, the second cylinder 102 includes a second piston rod 106 extended upward, and the hitting member 6 includes a connecting part 104 extended in contact with an upper end of the second piston rod 106.

In one or more embodiments, the first cylinder 101 and the second cylinder 102 may be a hydraulic cylinder or a pneumatic cylinder. When there is an available space in the front and rear direction in the front body 52, the first cylinder 101 and the second cylinder 102 may be disposed back and forth in the front body 52. However, when a space in the front and rear direction is not enough, the first cylinder 101 and the second cylinder 102 may be disposed by offsetting laterally from each other as shown in FIGS. 9 to 10.

FIGS. 11 and 12 show the flow path 103 communicating the first cylinder 101 and the second cylinder 102, respectively. According to an embodiment of FIG. 11, the flow path 103 connects a side wall of the first cylinder 101 and a side wall of the second cylinder 102 to each other, and according to another embodiment of FIG. 12, the flow path 103 connects the side wall of the first cylinder 101 and a bottom surface the second cylinder 102. However, it is not limited thereto, and depending on shapes or sizes of the front body 52 or positions of the first cylinder 101 and the second cylinder 102 in the front body 52, the first cylinder 101 and the second cylinder 102 may be connected to each other by the flow path 103 of various shapes. Although FIGS. 9 to 13 are not shown in detail, the flow path 103 is formed inside the front body 52 in the fifth embodiment of the present invention.

Referring to FIG. 11, in one or more embodiments, the first cylinder 101 has the same volume as the second cylinder 102, and has a diameter D1 larger than another diameter D2 of the second cylinder 102 and is formed into a lower height than the second cylinder 102. Accordingly, a length of the first piston rod 105 connected to a piston 107 of the first cylinder 101 may be formed to be shorter than a length of the second piston rod 106 connected to a piston 108 of the second cylinder 102. According to such embodiment of the present invention, when the golf ball 2 is hit, as the front and the rear body 52 and 53 are compressed, a distance at which the second piston rod 106 ascends is longer than a distance at which the first piston rod 105 moves forward. Accordingly, even though the front body 52 and the rear body 53 are relatively close to each other, as the second piston rod 106 ascends highly, the hitting member 6 connected through the connecting part 104 may be actively lifted higher. Therefore, when the golf ball 2 is hit, as the second piston rod 106 is lifted higher in a short time in a process of compressing the front body 52 and the rear body 53, the friction at the point Q shown in FIG. 14*b* is remarkably reduced and the spin of the golf ball 2 may be smoother.

The golf putter head 3 in a state before hitting the golf ball 2 according to the fifth embodiment of the present invention is shown in FIG. 13*a*, and the golf putter head 3 in a state of after hitting the golf ball 2 according to the fifth embodiment of the present invention is shown in FIG. 13*b*. When the golf putter head 3 hits the golf ball 2 in the state of FIG. 13*a*, the front body 52 and the rear body 53 are close to each other, and as the first cylinder 101 is compressed, the second cylinder 102 communicating therewith by the flow path 103 is expanded. Accordingly, as the second piston rod 106 is lifted to lift the connecting part 104 as shown in FIG. 13*b*, the hitting member 6 moves upward. In case of the golf putter head 3 according to the fifth embodiment of the present invention as shown in FIG. 13, the first cylinder 101 and the first piston rod 105 reduce impact between the front body 52 and the rear body 53 during hitting, so that the fifth embodiment may have the same effect as the second embodiment of the present invention without a separate buffer. Moreover, as described above, the hitting member 6 may be lifted more actively. However, the embodiment of FIG. 13 is only a preferred embodiment, and size, number, and arrangement in a main body of each cylinder may be suitably modified as needed by those skilled in the art.

In FIG. 1, the golf putter 1 including the handle 4 connected to the head body 5 of the golf putter head 3 according to the first embodiment of the present invention is shown as an embodiment. In FIG. 8, the golf putter 1 including the handle 4 connected to the rear body 53 of the golf putter head 3 according to the third embodiment of the present invention is shown as an embodiment. In case of the golf putter 1 including the golf putter head 3 according to the second, the fourth and the fifth embodiment of the present invention, as in case of the golf putter 1 including the golf putter head 3 according to the third embodiment of the present invention as shown in FIG. 8, the handle 4 is connected to the rear body 53. When the user hits the golf ball using the golf putter including the golf putter head according to the first to the fifth embodiment of the present invention, as the golf ball is spun smoothly, the user can easily move the golf ball in the desired direction.

Although a preferred embodiment of the present invention has been described for illustrative purposes, those skilled in the art will appreciate that various modifications, additions and substitutions are possible, without departing from the scope and spirit of the invention as disclosed in the accompanying claims.

The invention claimed is:

1. A golf putter head, comprising:

a head body; and a hitting member provided at a front of the head body for hitting a ball, and to be freely slidable up and down within a predetermined range with respect to the head body, wherein the hitting member is shaped into a plate and at least one sliding part sliding with respect to the head body is provided on a side opposite to a golf ball hitting surface of the hitting member.

2. The golf putter head of claim 1, wherein, at the front of the head body, a guide member having a predetermined height is provided on a position corresponding to the at least one sliding part to guide sliding of the at least one sliding part of the hitting member within a predetermined range.

3. The golf putter head of claim 2, wherein at least one ball bearing for smooth sliding is disposed between the guide member and the at least one sliding part.

4. A golf putter comprising:

the golf putter head according to claim 1; and a handle connected to the head body of the golf putter head.

5. The golf putter of claim 4, wherein the head body includes a front body and a rear body, and the handle of the golf putter is connected to the rear body.

6. A golf putter head, comprising:

a head body; and a hitting member provided at front of the head body for hitting a ball, and to be freely slidable up and down within a predetermined range with respect to the head body, wherein the head body includes a front body in which the hitting member is mounted and a rear body provided to slide freely in a back and forth direction with respect to the front body.

7. The golf putter head of claim 6, further comprising:

at least one buffer provided between the front body and the rear body.

8. The golf putter head of claim 7, wherein the at least one buffer is one of a sponge, a spring, a cylinder, and a shock absorber.

9. The golf putter head of claim 6, further comprising:

a lifting device for actively lifting the hitting member with respect to the head body by transmitting compressive force between the front body and the rear body to the hitting member when a putter hits a golf ball.

10. The golf putter head of claim 6, wherein the rear body includes at least one horizontal rack gear at a front surface thereof, and the front body includes a pinion gear which is rotated on a shaft parallel with a longitudinal direction of the front body by back and forth movement of the horizontal rack gear, and the hitting member is provided with a vertical rack gear at a rear surface thereof which the rack gear moves up and down by rotation of the pinion gear.

11. The golf putter head of claim 10, wherein the pinion gear comprises a first pinion gear and a second pinion gear which have different diameters and are disposed on a rotational shaft, and one of the first and the second pinion gear is connected to the horizontal rack gear, and the other one is connected to the vertical rack gear.

12. The golf putter head of claim 6, further comprising:

an extension part included in the hitting member and projecting upwardly above an upper surface of the head body;

a first hinge connector provided on an upper end of the extension part;

a second hinge connector provided on an upper surface of the rear body; and a rod including a first and a second end which are respectively hinged to the first hinge connector and the second hinge connector.

13. The golf putter head of claim 6, further comprising:

a first cylinder horizontally provided at rear of the front body;

a second cylinder vertically provided on a upper part of the front body; and a flow path communicating from inside of the first cylinder to inside of the second cylinder, wherein the first cylinder includes a first piston rod extended toward the rear body, the second cylinder includes a second piston rod extended upward, and the hitting member includes a connecting part extended in contact with an upper end of the second piston rod.

14. The golf putter head of claim 13, wherein a diameter of the first cylinder is larger than a diameter of the second cylinder.

15. The golf putter head of claim 13, wherein the first and the second cylinder are a hydraulic cylinder or a pneumatic cylinder.

16. The golf putter head of claim 6, wherein, any one of the front body and the rear body is provided with at least one hole penetrating the body in the back and forth direction, and the other one thereof is provided with a shaft penetrating the at least one hole.

17. The golf putter head of claim 16, wherein any one of the front body and the rear body is provided with a linear bush to smooth linear motion in the back and forth direction of the shaft moving through the at least one hole.

18. The golf putter head of claim 16, wherein the shaft is provided with a shock absorbing member on an outer circumference thereof to relieve shock between the front body and the rear body.

19. A golf putter comprising:

the golf putter head according to claim 6; and a handle connected to the head body of the golf putter head.

* * * * *